United States Patent [19]

Deaver

[11] Patent Number: 4,749,846

[45] Date of Patent: Jun. 7, 1988

[54] PRICE COMPARISON DEVICE

[76] Inventor: Robert M. Deaver, 155 West 68th St., New York, N.Y. 10023

[21] Appl. No.: 362,649

[22] Filed: Mar. 29, 1982

[51] Int. Cl.[4] ..... G06G 1/02

[52] U.S. Cl. ..... 235/70 B

[58] Field of Search ..... 235/89 R, 70 R, 69, 235/61 B, 70 B, 85 R; 40/110, 109

[56] References Cited

U.S. PATENT DOCUMENTS

| | | | |
|---|---|---|---|
| 450,640 | 4/1891 | Smith | 235/70 B |
| 3,436,012 | 4/1969 | Stephenson | 235/61 B |
| 3,760,165 | 9/1973 | Marcks | 235/89 R |
| 3,815,269 | 6/1974 | Roselli | 235/89 X |

FOREIGN PATENT DOCUMENTS

| | | | |
|---|---|---|---|
| 321573 | 11/1929 | United Kingdom | 40/110 |

*Primary Examiner*—L. T. Hix
*Assistant Examiner*—Della Rutledge
*Attorney, Agent, or Firm*—Handal & Morofsky

[57] ABSTRACT

A card (10) with scales (20, 24, 28) printed thereon for the comparison of dissimilar items. Means (36) are provided for linearly intersecting representative points on two scales (20, 24) and for obtaining desired information from the third scale (28).

8 Claims, 2 Drawing Sheets

PRICE COMPARISON DEVICE

TECHNICAL FIELD

The invention relates to a comparison and memory device of the type which among other functions allows fast comparison between per unit prices for products which have different quantities measured in the same type of units.

BACKGROUND ART

With increasing public awareness of the high cost of living, efficient allocation of limited resources such as money, energy, and time has become essential. Consequently, with the large variation of measures of goods and services available in everyday life, a need has arisen for quick comparison of items of different quantities and even of different measures of value. In daily shopping, for example, where goods are sold in varying quantities of ounces or grams, it is necessary to calculate the price of the goods per ounce or gram in order to determine which brand and which quantity offers the optimum cost per unit of goods. This comparison requires convenient mathematical computation. While some such calculations can be performed mentally, others are too complex to determine without some form of mechanical assistance. Pencil and paper or even a calculator can be of assistance in this situation, but neither is convenient and the quicker of these two, the calculator, is costly and bulky. A third method of calculation is a premade triple scale printed card which allows rapid calculation by placing a straight edge across two scales of the card, intersecting the appropriate numerals corresponding to each product's quantity and cost. At the intersection of the straight edge with the third scale the desired calculation can be read. Performing this process for two products allows a mental comparison of cost per unit of quantity. This method has the disadvantage of requiring a printed card and the secondary device of a straight edge. Carrying these two pieces of equipment during shopping is awkward.

Alignment of the straight edge is also difficult since pressure must be exerted on the straight edge at the first aligned intersection point to prevent it from slipping while the second intersection point is aligned. If the edge slips an inaccurate calculation will be obtained.

DISCLOSURE OF THE INVENTION

In accordance with the present invention, a calculation and comparison device has been devised which combines the immediately viewable comparison, low cost, size and weight of a triple scale printed calculation card with an improved straight edge alignment device. Unlike a calculator or pencil and paper, where two computed figures must be mentally compared, the present invention displays the relative values for comparison on a single printed scale so that only a visual inspection is required to form a comparative conclusion. The printed card display device is also small in size and weight for convenient pocket or wallet storage and is much less expensive than a calculator. The improved straight edge alignment device includes a mechanical memory feature which eliminates the problem of straight edge slipping, and which stores the previously aligned first intersection point until just prior to alignment of the second intersection point to allow easy comparison without relying on the memory of the user.

BRIEF DESCRIPTION OF THE DRAWINGS

A way of carrying out the invention is described in detail below with reference to drawings which illustrate only one example of a specific embodiment of the invention, in which.

DETAILED DESCRIPTION OF THE PREFERRED EMBODIMENT

Figure 1:
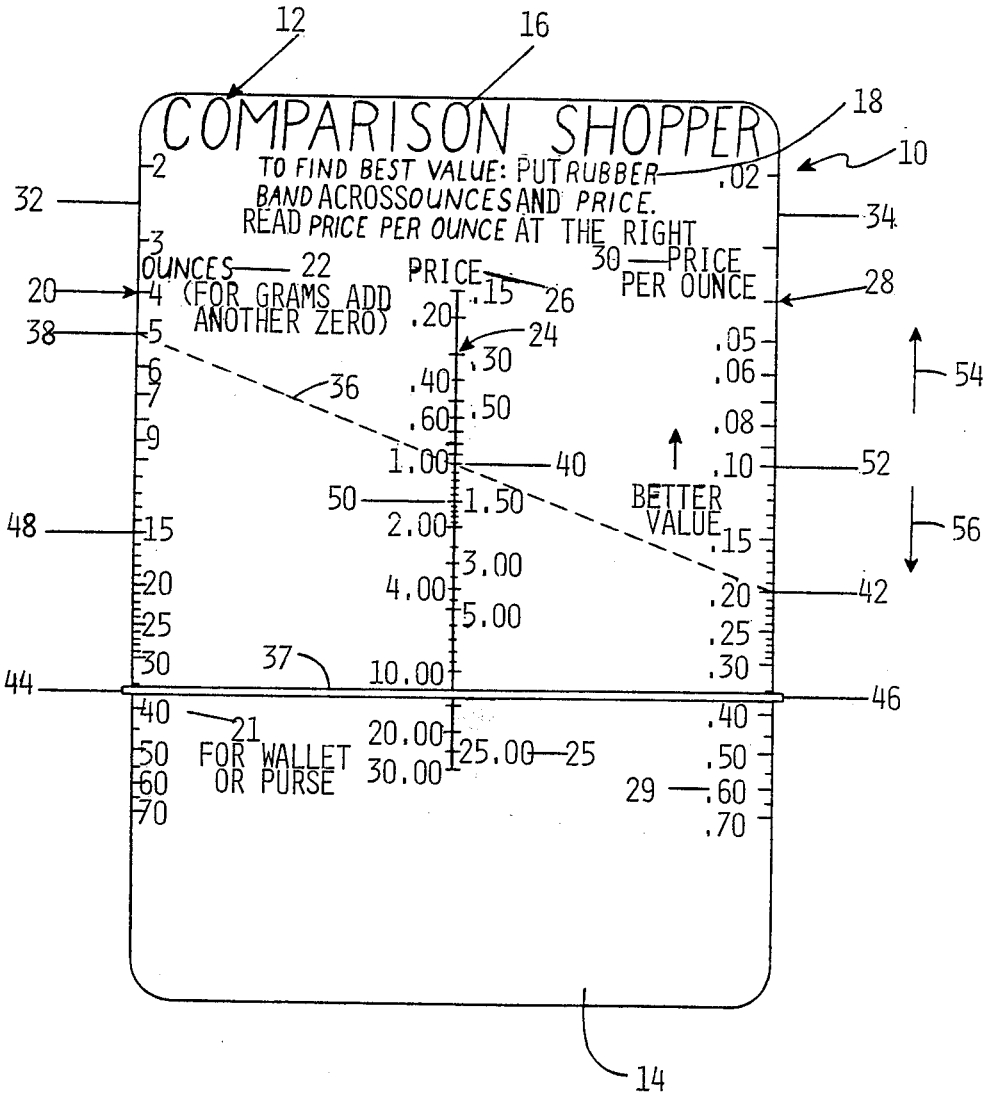
FIG. 1 is a plan view of a card-type comparison device constructed in accordance with the present invention.
Figure 2:
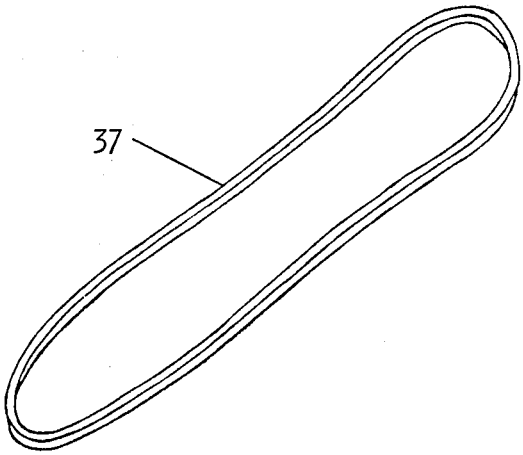
FIG. 2 allows an indicator for use in the present invention.

Referring to FIG. 1, a calculator and comparison card 10 in accordance with the present invention includes printed matter 12 on front surface 14 of card 10. Printed matter 12 includes a title 16, directions 18 for use of card 10, scales 20, 24, and 28, (including numerical indications 21, 25, and 29) and labels 22, 26, and 30 for designation of the units of measure of scales 20, 24, and 28, respectively.

Scales 20 and 28 are respectively positioned adjacent to outer edges 32 and 34 of card 10, and scale 24 is printed approximately one-half of the distance between edges 32 and 34 of card 10.

Explanatory printed straight edge 36 illustrates intersection on scales 20, 24 and 28 and operation of the inventive card 10. In FIG. 1, straight edge 36 is shown intersecting scales 20, 24, and 28 at points 38, 40, and 42, respectively. In the preferred embodiment of the invention, a rubber band 37 adjustably performs the function of printed straight edge 36. This rubber band 37 is wrapped around both edges 32 and 34 of card 10 and is held in place by natural constriction because the unstretched inner circumference of rubber band 37 is less than twice the distance between edges 32 and 34. Card 10 is constructed of a sufficiently rigid material to prevent curvature of card 10 due to the constrictive force of rubber band 37. Friction between the flexible material of rubber band 37 and card 10 prevents rubber band 37 from shifting without external pressure on rubber band 37. To protect the printed matter on the card from wear, card 10 may be provided with a plastic coating.

Considering use of the inventive device starting with a calculation corresponding to printed line 36, the consumer-operator first positions end 44 of rubber band 37 so that end 44 intersects scale 20 at intersection points 38 representing, for example, the quantity (five ounces) of an item to be evaluated. With end 44 of rubber band 37 properly aligned the other end 46 of rubber band 37 is rotated around intersection point 38 by pulling and exerting upward or downward pressure at end 46 until rubber band 37 intersects the price of the item to be evaluated at intersection point 40 (one dollar) of scale 24. With rubber band 37 properly aligned at intersection points 38 and 40, the evaluation of the item in terms of cost per ounce can be obtained by reading scale 28 at intersection point 42 (twenty cents per ounce). When a second item is to be compared with the cost per ounce of twenty cents, represented by the placement of rubber band 37 over printed line 36, rubber band 37 is pivoted about point 42, which indicates the price per ounce of the first item, until it intersects point 48 on scale 20 which indicates the quantity (e.g. fifteen ounces) of the second item to be compared. The item which has the least cost per unit volume or weight can be determined by visual inspection of which direction end 46 of rubber band 37 will have to be moved along scale 28 if pivoted about point 48 in order to align rubber band 37 with point 50 (one dollar and fifty cents) on scale 24, the price of the second item being compared. Since end 46 of rubber band 37 will have to be moved in the upward direction which correlates to a decrease in price per ounce along scale 28, as indicated by arrow 54, the consumer can determine visually that the price per ounce of the second item will be less than the first item, which is still indicated by the intersection of end 46 of rubber band 37 with scale 28 at point 42. This price comparison may be obtained without determination of the absolute figure value of the second item's cost per ounce. Conversely, if end 46 of rubber band 37 had to be moved in the downward direction of arrow 56 in order for rubber band 37 to intersect the price of the second item on scale 24 while fixed on the point indicating the number of ounces of the second item on scale 20, the consumer can visually determine that the price per ounce of the second item is greater that the price per ounce of the first item. Finally, in completing calculation of the second item's price per ounce, end 46 of rubber band 37 would be placed over point 52 on scale 28 and indicate a price of 10 cents per ounce.

While an illustrative embodiment and one use of the present invention has been illustrated, it is of course understood that various modifications will be obvious to those of ordinary skill in the art. Additional uses may be for computations relating to miles per gallon, crop yield per acre, wind-chill index, market value of investment, percentage gain or loss on investment, compound interest and markups and discounts. Such modifications are within the spirit and scope of the invention, which is limited and defined only by the appended claims.

I claim:

1. A calculating and comparison device comprising:

(a) a flat planar member with first and second confronting peripheral edges;

(b) first scale means disposed on one side of said flat planar member, said first scale means comprising a first set of demarcations disposed on said flat planar member and a first set of numerical indicia correlated to said first set of demarcations, said first scale means being positioned so that said first set of demarcations corresponding to said first scale means abuts said first peripheral edge of said planar member;

(c) second scale means disposed on said planar member, said second scale means comprising a second set of demarcations disposed on said planar member and a second set of numerical indicia correlated to said second set of demarcations, said second set of demarcations being positioned at points removed from said first set of demarcations;

(d) stretchable alignment means configured and dimensioned to grippingly engage one of a plurality of points on said first peripheral edge and one of a plurality of points on said second peripheral edge, for indicating a first point on said first scale means and simultaneously indicating a second point on said second scale means said stretchable alignment means being capable of stretching to a length required when said alignment means is grippingly engaging said first and second peripheral edges and is oriented at an angle of sixty degrees, and the length of said stretchable alignment means being much greater than its width;

(e) third scale means disposed on said planar member, comprising a third set of demarcations and a third set of numerical indicia correlated to said third set of demarcations, said third scale means being positioned, configured and dimensioned to have a particular point on said third scale means indicated by said alignment means simultaneously with the indication of said first and second points on said first scale means and said second scale means, the numerical indicia associated with the particular point indicated on said third scale means being selected so that the numerical value associated with the numerical indicia associated with said particular point is a function of a desired mathematical relationship and the numerical values associated with the numerical indicia simultaneously indicated on said first scale means and said second scale means by said alignment means, said third scale means being positioned so that said third set of demarcations corresponding to said third scale means abuts said second peripheral edge of said planar member, said second scale means being positioned between said first scale means and said third scale means.

2. A device as in claim 1 wherein said device includes a permanently imprinted alignment member for facilitating a user's learning how to use the device.

3. A device as in claim 1, wherein, said alignment means is a rubber band dimensioned to be disposed around and secured snugly to opposite peripheral edges of said flat planar member at a plurality of positions.

4. A device as in claim 1, wherein said first, second and third scale means are separate from each other and are all printed on the same side of said planar member.

5. A device as in claim 1 or 3 wherein, said first, second and third scale means are all printed on the same side of said planar member.

6. A calculating and comparison device comprising:

(a) a flat planar member with first and second confronting peripheral edges;

(b) first scale means disposed on one side of said flat planar member, said first scale means comprising a first set of demarcations disposed on said flat planar member and a first set of numerical indicia correlated to said first set of demarcations;

(c) second scale means disposed on said planar member, said second scale means comprising a second set of demarcations disposed on said planar member and a second set of numerical indicia correlated to said second set of demarcations, said second set of demarcations being positioned at points removed from said first set of demarcations;

(d) stretchable alignment means configured and dimensioned to grippingly engage one of a plurality of points on said first peripheral edge and one of a plurality of points on said second peripheral edge, for indicating a first point on said first scale means and simultaneously indicating a second point on said second scale means said stretchable alignment means being capable of stretching to a length required when said alignment means is grippingly engaging said first and second peripheral edges and is oriented at an angle of sixty degrees, and the length of said stretchable alignment means being much greater than its width;

(e) third scale means disposed on said planar member, comprising a third set of demarcations and a third set of numerical indicia correlated to said third set of demarcations, said third scale means being positioned, configured and dimensioned to have a particular point on said third scale means indicated by said alignment means simultaneously with the indication of said first and second points on said first scale means and said second scale means, the numerical indicia associated with the particular point indicated on said third scale means being selected so that the numerical value associated with the numerical indicia associated with said particular point is a function of a desired mathematical relationship and the numerical values associated with the numerical indicia simultaneously indicated on said first scale means and said second scale means by said alignment means.

7. A device as in claim 1 or 6, further comprising an imprinted indicia indicating the direction of more desirable conditions on said third scale means.

8. A device as in claim 1 or 6 wherein said third scale means is positioned so that said third set of demarcations corresponding to said third scale means abuts said second peripheral edge of said planar member.

* * * * *